US012018916B1

(12) United States Patent
Morris

(10) Patent No.: US 12,018,916 B1
(45) Date of Patent: Jun. 25, 2024

(54) SLIDE CAPTURE HANDGUN SIGHT PUSHER

(71) Applicant: New Revo Brand Group, LLC, Plymouth, MN (US)

(72) Inventor: Matthew C. Morris, Minneapolis, MN (US)

(73) Assignee: New Revo Brand Group, LLC, Plymouth, MN (US)

( * ) Notice: Subject to any disclaimer, the term of this patent is extended or adjusted under 35 U.S.C. 154(b) by 5 days.

(21) Appl. No.: 18/154,466

(22) Filed: Jan. 13, 2023

(51) Int. Cl.
*F41G 1/54* (2006.01)

(52) U.S. Cl.
CPC ..... *F41G 1/545* (2013.01)

(58) Field of Classification Search
CPC ..... F41G 1/545
USPC ..... 42/108, 124
See application file for complete search history.

(56) References Cited

U.S. PATENT DOCUMENTS

| | | | | |
|---|---|---|---|---|
| 7,621,065 | B2 | 11/2009 | Gablowski | |
| 8,316,573 | B2 | 11/2012 | Bietsch | |
| 8,397,422 | B2 | 3/2013 | Bietsch | |
| 8,707,609 | B2 | 4/2014 | Fisher | |
| 8,910,413 | B2 | 12/2014 | Hillwig, Jr. | |
| 9,593,910 | B1 | 3/2017 | Fisher | |
| 9,784,535 | B1 * | 10/2017 | Cheng | F41G 1/545 |
| 10,955,219 | B1 * | 3/2021 | Morris | F41G 1/545 |
| 11,199,378 | B2 * | 12/2021 | LoRocco | F41G 1/545 |
| 11,226,174 | B1 * | 1/2022 | Chen | F41G 1/545 |
| D960,679 | S * | 8/2022 | Zhou | D22/108 |
| 2011/0167702 | A1 * | 7/2011 | Bietsch | F41G 1/545 254/1 |
| 2021/0364253 | A1 * | 11/2021 | Chen | F41G 1/545 |

FOREIGN PATENT DOCUMENTS

CN 306104134 10/2020

OTHER PUBLICATIONS

AliExpress, Universal Rear Sight Pusher Tool for Glock 1911 Sig and Others Handgun Sight Pusher Tool Removal Tool Sight Adjustment, https://www.aliexpress.us/item/3256804146519158.html, accessed Jan. 18, 2023.

(Continued)

*Primary Examiner* — Samir Abdosh
(74) *Attorney, Agent, or Firm* — GRUMBLES LAW PLLC; Bryan Kravis

(57) ABSTRACT

A slide capture handgun sight pusher can include a handgun sight adjustment device that can include a frame having a front and back face where a central opening can be disposed therethrough, along with a first and second side. Further included can be a firearm slide catch mechanism that can be structured to attach to the internal rails of a firearm's slide, having an adjustable sight. The firearm slide catch can include a cap, an adjustment knob, and a shaft that can be disposed between the cap and adjustment knob, where the adjustment knob can be configured to change a distance between the cap and the first side. The firearm slide catch can work in conjunction with various shims to adjust to fit the firearm slide with the sight adjustment device. This may include a sight pusher that may include a press-block tooth having multiple engagement surfaces.

24 Claims, 12 Drawing Sheets

(56) References Cited

OTHER PUBLICATIONS

Midway USA, Glock Factory Rear Sight Mounting Tool All Models, https://www.midwayusa.com/product/1007070924?pid=113142, accessed Jan. 18, 2023.
Midway USA, MGW Rear Sight Tool Glock for Straight Sided Sights, https://www.midwayusa.com/product/1015877875?pid=111366, accessed Jan. 18, 2023.
Midway USA, MGW Rear Sight Tool Glock, https://www.midwayusa.com/product/1007109821?pid=884401, accessed Jan. 18, 2023.

* cited by examiner

SLIDE CAPTURE HANDGUN SIGHT PUSHER

FIELD OF THE INVENTION

This disclosure relates to firearm maintenance aids, and, more particularly, relates to tools for adjusting gun sights on a pistol slide.

BACKGROUND OF THE INVENTION

Gun sights are used on firearms to aid in aiming the firearm, and proper aim is critical to ensure an accurate shot is taken. A standard handgun sight includes a single raised projection centered at the top, front surface of the gun slide, and a rear sight that is an elongate projection with a central notch at the rear of the slide. To aim the gun, the target is aligned with the front sight, and the front sight is aligned within the notch of the rear sight.

If the gun is not properly sighted, the user's aim will be inaccurate. Further, individuals may desire a different type of sight and may therefore need to replace the sight that is currently on their gun. Therefore, there are times when a gun sight will need to be adjusted or replaced, and a device is needed that can facilitate these activities.

SUMMARY

This disclosure relates to firearm maintenance aids, and, more particularly, relates to tools for adjusting gun sights on a pistol slide. In one aspect, the disclosure provides a sight adjustment device that can include a frame having a front and back face where a central opening can be disposed therethrough, and a first and second side; a firearm slide catch can be connected to the first side, where the firearm slide catch can include a cap, an adjustment knob, a shaft that can be disposed between the cap and adjustment knob, where the adjustment knob can be configured to change a distance between the cap and the first side, and a spring can be disposed between the first side and adjustment knob; and a sight pusher that can be at least partially disposed through a second side of the frame, which may include a threaded rod connected to a handle and a press-block tooth can be disposed on the threaded rod.

In some embodiments, the slide catch may be structured to receive at least one shim and may also be structured to abut interior rails of a firearm slide. Further embodiments can include a firearm slide catch that may be capable of receiving at least one shim while remaining connected to the adjustment knob. Additional embodiments may also include a cap that can be approximately rectangular and rotatable into consecutive ninety-degree orientations while remaining connected via the shaft to the adjustment knob. In some subsequent embodiments, the shaft of the firearm slide catch can comprise at least two geometric segments that are stacked in line with the cap, where a first segment may have an approximately rectangular shape, and a second segment may have an approximately cylindrical shape. In some of those subsequent embodiments, the second segment may have a diameter less than a width of the first segment.

Further embodiments can include a shim that may be penannular, where a central interior opening can be shaped to match the first segment of the shaft and can include a side opening, leading to the central interior opening.

In some other embodiments, a firearm slide catch can further include a threaded bolt that may be configured to be received by the shaft and the adjustment knob.

Additional embodiments of the sight adjustment device can include configurations where the cap on the firearm slide catch can include a stepped configuration, where there may be a top step which can be wider and longer than a bottom step, and where a first distance between a length of the top step and a length of the bottom step can be different from a second distance between a width of the top step and a width of the bottom step.

Other embodiments of the sight adjustment device can include a handgrip that may be disposed on an exterior surface of a third side of the frame; such an embodiment may also include a tool storage component within the handle of the sight pusher. Alternative embodiments of the sight adjustment device can include the press-block tooth, where there may be at least two engagement surfaces. An additional alternative embodiment of the sight adjustment device can include the press-block tooth, which can include a first engagement surface that may be a vertical surface and may also include a second engagement surface that may be a multi-tapered surface.

A method of using a sight adjustment device may include the steps of providing a sight adjustment device that may include: a frame having a front face, a back face, a central opening that may be disposed through the front face to the back face, a first side, and a second side, a firearm slide catch that can be disposed within the first side of the frame, and where the firearm slide catch may include a cap that may have at least four faces, an adjustment knob, a shaft that can be disposed between the cap and the adjustment knob, a spring that may be disposed between the first side and the adjustment knob, and a sight pusher that may be disposed through a second side of the frame; where the next step can be determining a distance between rails of a firearm slide; a further step can be depressing the adjustment knob, which may compress the spring; an additional step that can be rotating the cap to match a width of the cap to the distance between rails of the firearm slide; followed by a step that can be determining a distance between the rails of a firearm slide and a bottom of the firearm slide; where an further step can be releasing the adjustment knob which may then decompress the spring; and where an additional step can be securing the firearm slide onto the sight adjustment device by turning the adjustment knob in a first direction.

Further embodiments of the method of using the sight adjustment device can include the cap, which may be approximately rectangular and may be able to rotate into consecutive ninety-degree orientations. Additional steps can be inserting at least one shim between the firearm slide catch and the frame. Aspects of the method may include the shaft that can be at least two geometric segments where a first segment may have an approximately rectangular shape which may be disposed on the cap, and a second segment, that may have an approximately cylindrical shape and can be disposed on the first segment opposite the cap; where an additional step can be the compressing of the spring which may free the first segment of the shaft from the frame, and the decompressing of the spring can allow the reinsertion of the first segment of the shaft into the frame in a desired orientation.

Additional aspects of the method of using the sight adjustment device can include the second segment, which may have a diameter less than a width of the first segment. This may further include the at least one shim that may be penannular, which can include a central interior opening shaped to match the first segment of the shaft and a side opening, that can lead to the central interior opening, wherein the side opening can be configured to match the diameter of the second segment. A further aspect of the method of using the sight adjustment device can include the cap that may be a stepped configuration, where a top step can be wider and longer than a bottom step.

An additional embodiment for a sight adjustment device for a firearm may include a frame that may be comprised of a front and back face, a first and second side, where a central opening may be disposed through the front face to the back face, which can include a firearm slide catch that may be connected to the first side of the frame, and may have a cap, an adjustment knob, a shaft that can be disposed between the cap and the adjustment knob, where the adjustment knob can be structured and configured to change a distance between the cap and the first side, a spring can be disposed between the first side and the adjustment knob, and where the firearm slide catch can be structured and configured to receive at least one shim, while the adjustment knob can remain operably connected to the shaft; and where a sight pusher can be included that may have a threaded rod, a handle, and a press-block tooth.

Additional aspects of such an embodiment may include at least one shim that can be penannular with a central interior opening that may be shaped to match a first segment of the shaft and a side opening, that can lead to the central interior opening, wherein the side opening may be configured to match a diameter of a second segment of the shaft. Such embodiments may also include the first segment of the shaft that, can have an approximately rectangular shape and may be disposed on the cap, and where the second segment of the shaft can be an approximately cylindrical shape and may be disposed on the first segment opposite the cap. Further embodiments may also include the cap that can be approximately rectangular and may also be rotatable into consecutive ninety-degree orientations while the adjustment knob can remain connected to the shaft.

An additional embodiment may also include the sight adjustment device that can have the press-block tooth which may be comprised of at least two engagement surfaces, wherein a first engagement surface of the press-block tooth can be a vertical surface, and a second engagement surface of the press-block tooth can be a multi-tapered surface.

The above summary is not intended to describe each and every example or every implementation of the disclosure. The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
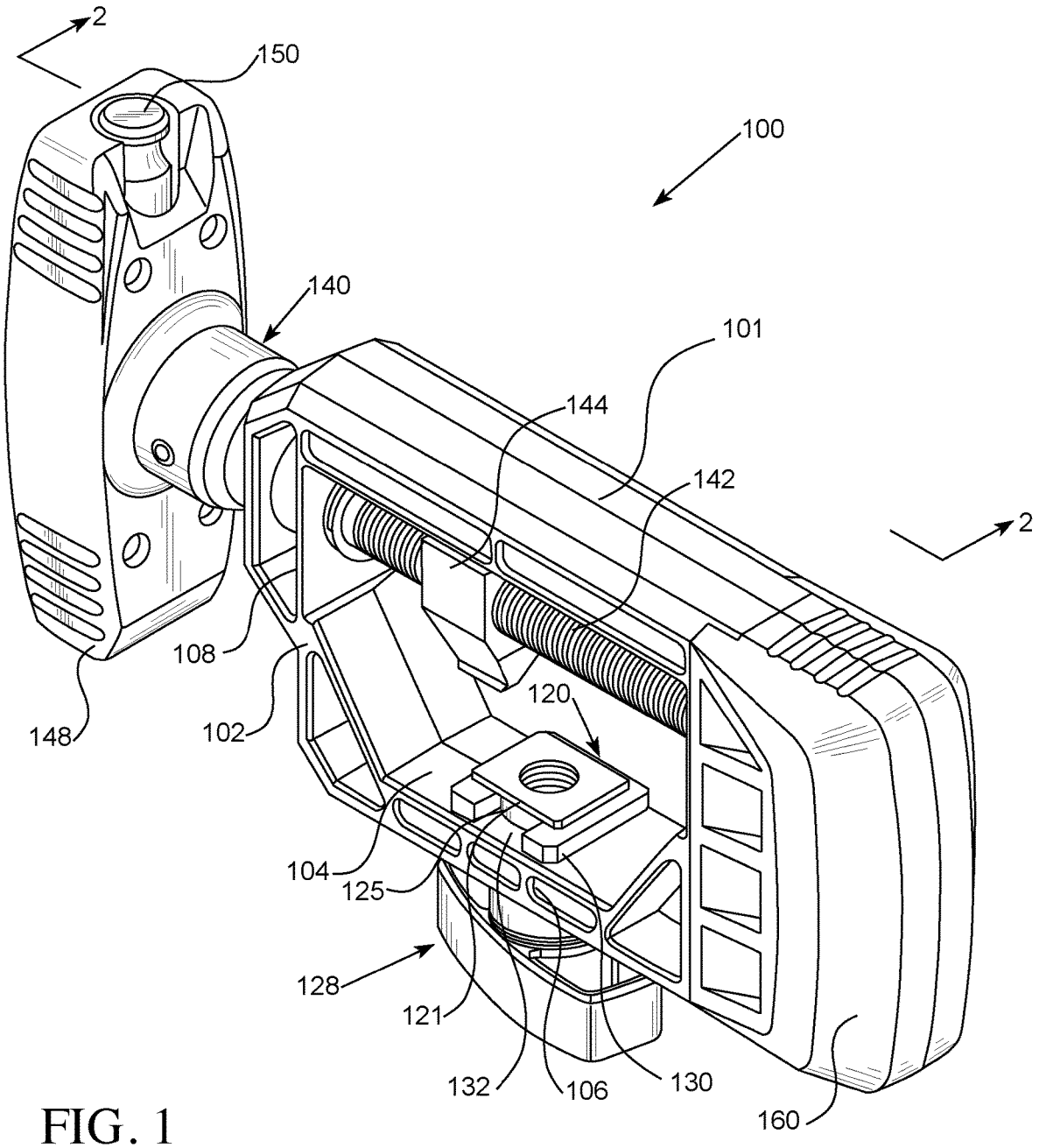
FIG. 1 is a front perspective view of an illustrative example of a slide capture handgun sight pusher of the present disclosure.

The present disclosure relates to firearm maintenance aids, and, more particularly, relates to tools for adjusting gun sights on a pistol slide. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements; those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

FIG. 1 is a front-perspective view of an illustrative example of a slide capture handgun sight pusher. The slide capture handgun sight pusher 100 includes frame 101 with a front face 102 and a rear face 103. Between the front face 102 and the rear face, 103 can be a central opening 104. Within frame 101 can be a first side 106 where a slide catch mechanism 120 may be disposed therethrough. The slide catch mechanism 120 may comprise a cap 121, which may include a first tier 122 and a second tier 124. The cap 121 may be disposed onto a shaft 125, which may further be disposed onto an adjustment knob 128. Further illustrated in FIG. 1 is an embodiment of slide catch mechanism 120 where a shim 130 can be disposed between the cap 121 and the first side 106. The shim 130 may be penannular and include an opening 132 that will be discussed infra.

Additionally, within frame 100 is a second side 108 that can include a sight pusher control 140. The sight pusher control 140 may include an ergonomic handle 148, which may further include a stored tool 150. Attached to the ergonomic handle 148 and disposed through the second side 108 may be a threaded rod 142 that may further include a press-block tooth 144. The threaded rod 142 may have a proximal end disposed within the ergonomic handle 148 and a distal end disposed within a third side opposite the second side 106; the distal end of the threaded rod 142 may include a bearing to enhance the rotation of the threaded rod 142. The third side may also include a finger grip 160, as illustrated in FIG. 1.

Figure 2:
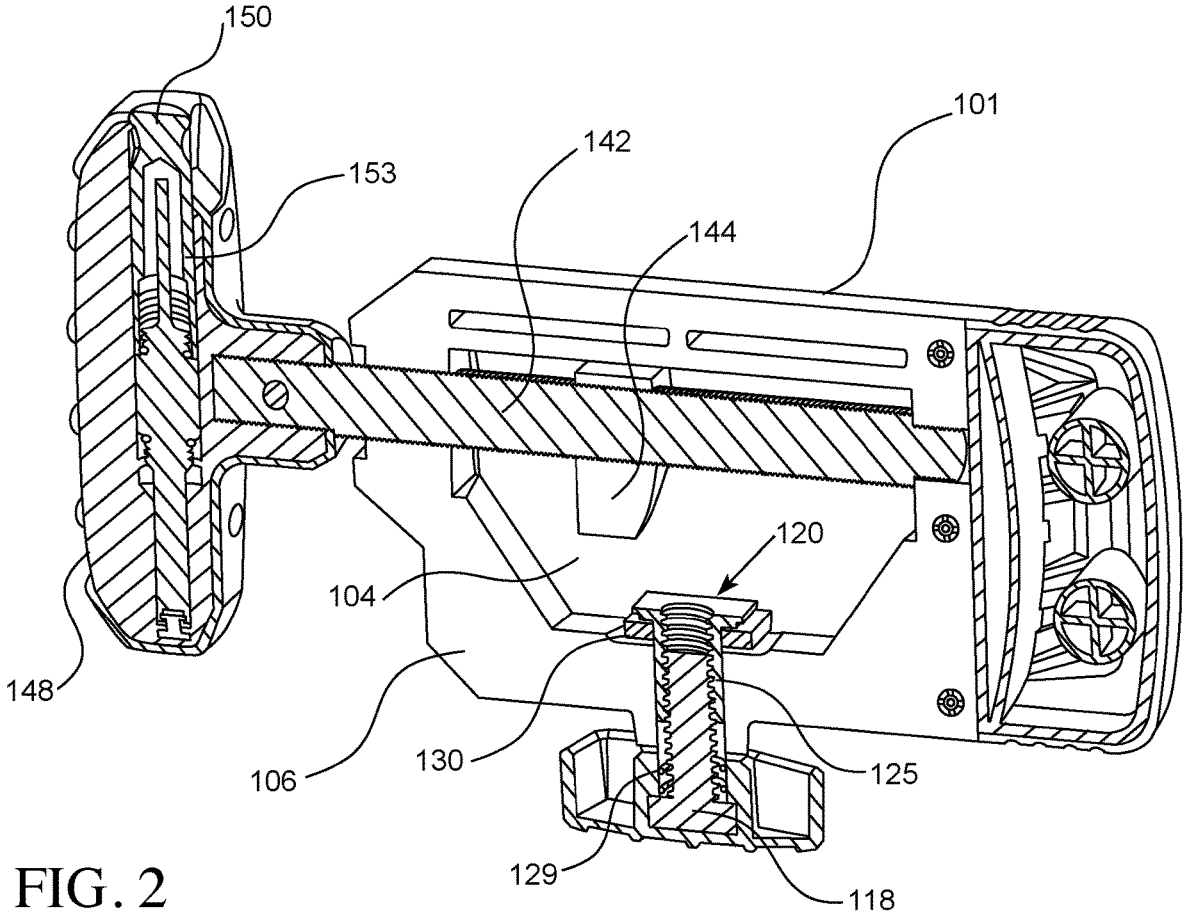
FIG. 2 is a cross-section view of the slide capture handgun sight pusher of FIG. 1.

FIG. 2 is a cross-sectional view of the slide capture handgun sight pusher 100 of FIG. 1. The illustration in FIG. 2 reveals some of the possible internal structures of the slide capture handgun sight pusher 100. For example, within the slide catch mechanism 120, there may be a spring 129 disposed about the shaft 125 and also between the first side 106 and the adjustment knob 128. The spring 129, in some embodiments, can also be disposed between a washer 123 and the adjustment knob 128; the washer 123 may abut the first side 106 to prevent marring the outer surface of the first side 106. In other potential embodiments, the spring 129 may be disposed about a threaded bolt 118. The threaded bolt 118 can be disposed within the adjustment knob 128. The spring 129 may be disposed between the first side 106 and the adjustment knob 128. Further revealed in the cross-sectional view of FIG. 2 is a tool storage compartment 153 within the ergonomic handle 148, where tool 150 is being stored.

Figure 3:
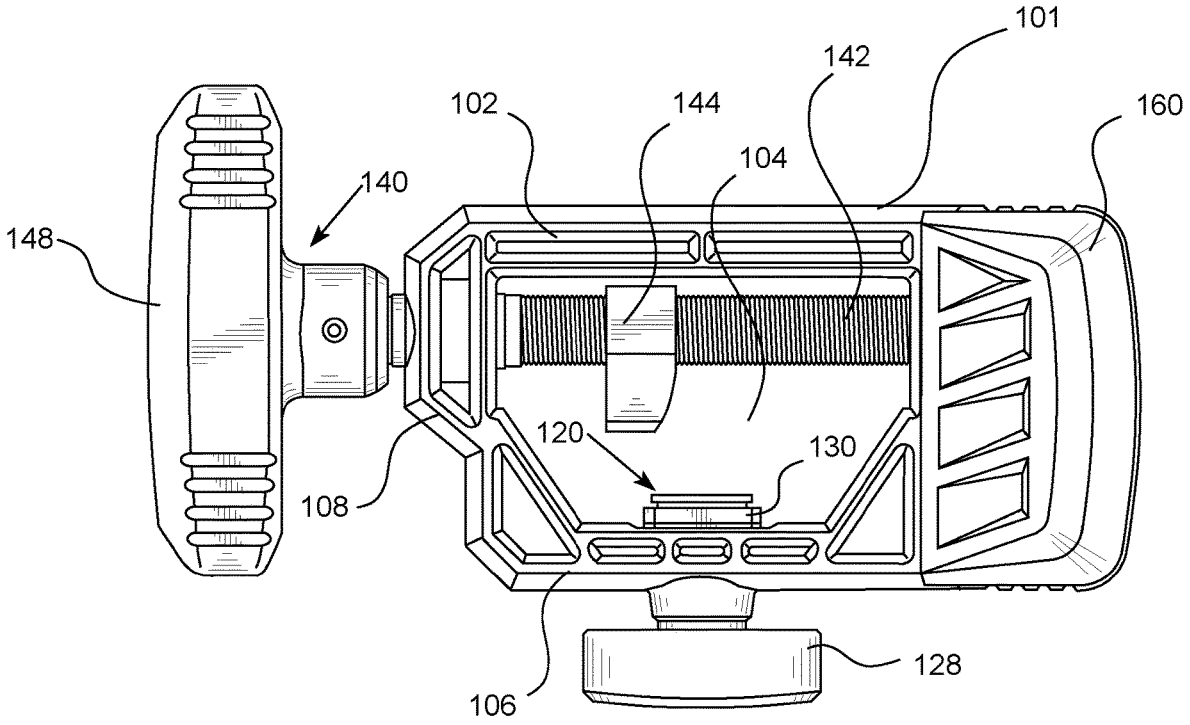
FIG. 3 is a front plan view of the slide capture handgun sight pusher of FIG. 1.
Figure 4:
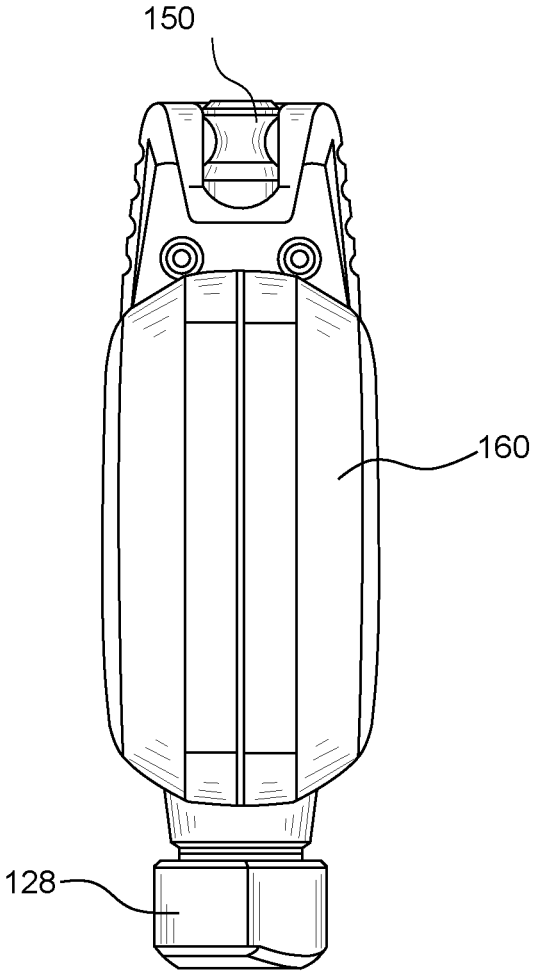
FIG. 4 is a right side view of the slide capture handgun sight pusher of FIG. 1.
Figure 5:
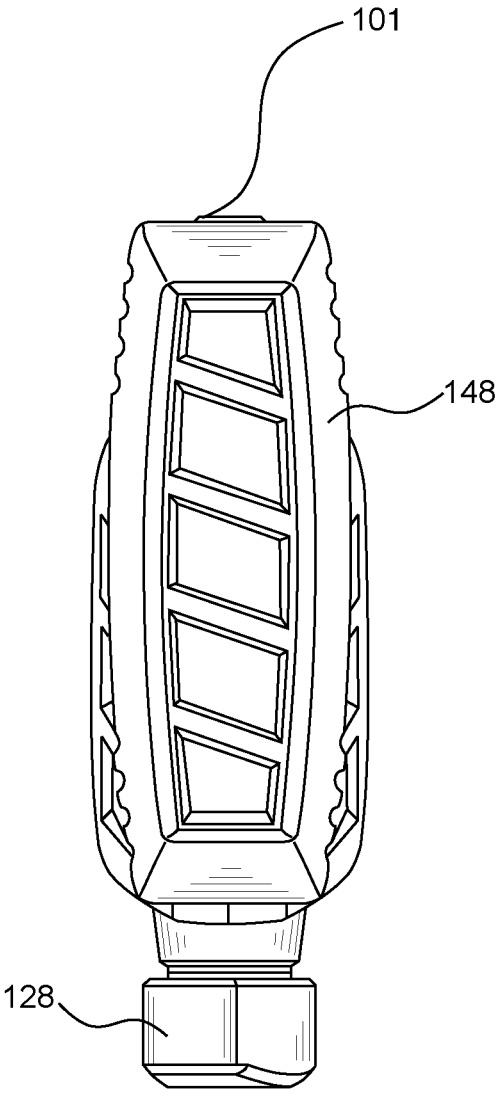
FIG. 5 is a left side view of the slide capture handgun sight pusher of FIG. 1.

FIG. 3 is a front plan view of a slide capture handgun sight pusher 100. Within FIG. 3, the central opening 104 can be disposed within frame 101 and disposed through the front face 102. The slide catch mechanism 120 can be disposed within the first side 106, and the sight pusher control 140 can be disposed through the second side 108. A shim 130 disposed within the slide capture mechanism 120 is an alternative configuration where opening 132 of the shim 130 can be oriented opposite the front face 102. FIG. 4 is a right side view of a slide capture handgun sight pusher 100 where a finger grip 160 can be disposed within a third side of the frame 101, and an adjustment knob 128 is disposed on the first side. FIG. 5 is a left side of a slide capture handgun sight pusher 100, where an ergonomic handle 148 is disposed through a second side of frame 101, and an adjustment knob 128 is disposed on the first side.

Figure 6:
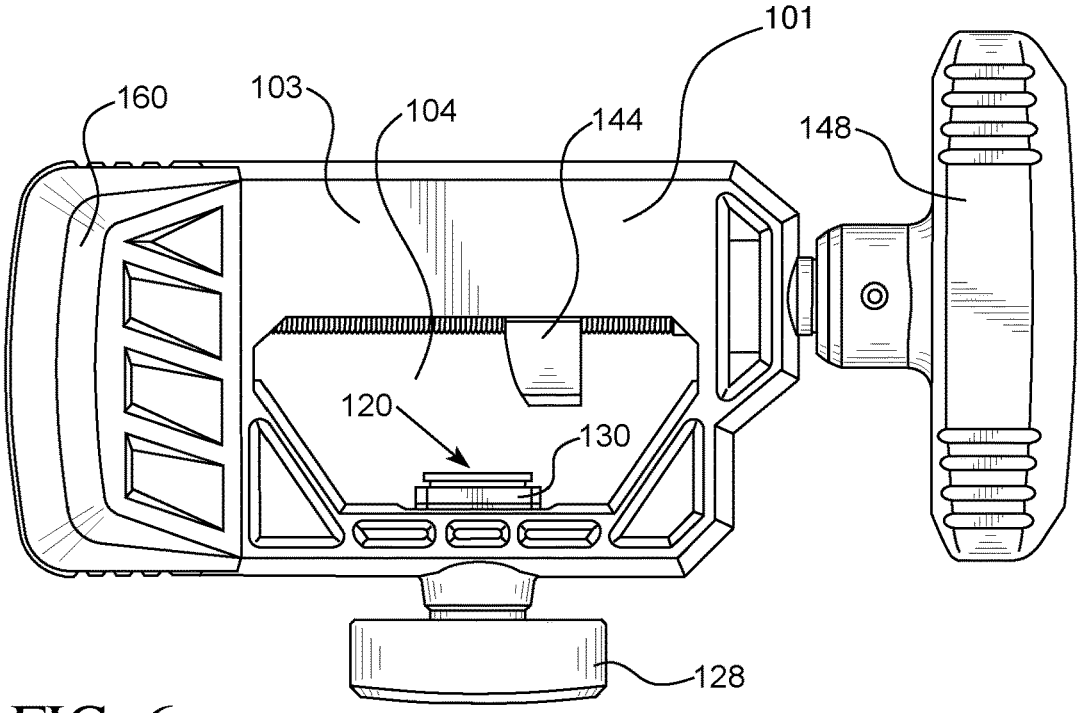
FIG. 6 is a rear plan view of the slide capture handgun sight pusher of FIG. 1.
Figure 7:
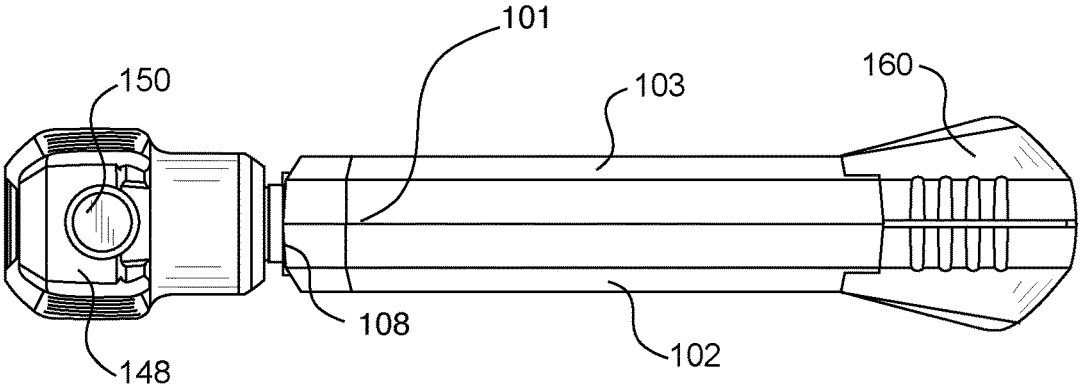
FIG. 7 is a top plan view of the slide capture handgun sight pusher of FIG. 1.
Figure 8:
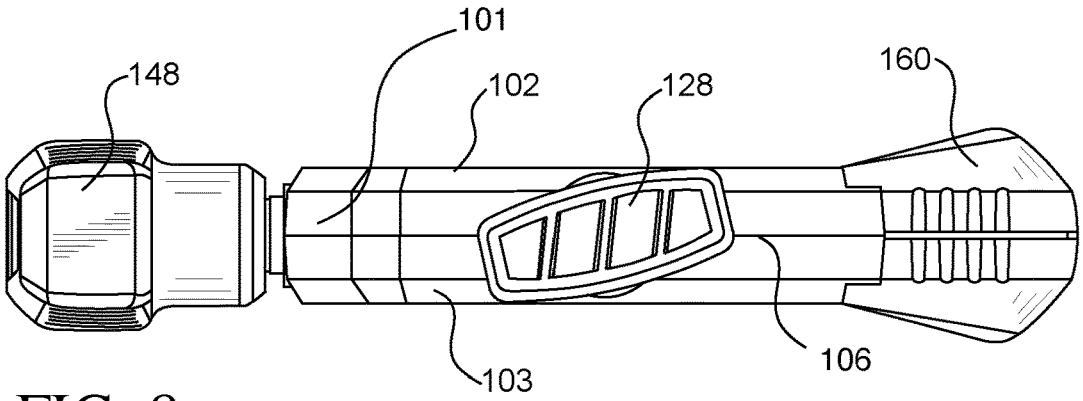
FIG. 8 is a bottom plan view of the slide capture handgun sight pusher of FIG. 1.

FIG. 6 is a rear view of a slide capture handgun sight pusher 100. Within FIG. 6, the central opening 104 can be disposed within frame 101 and disposed through the rear face 103. The slide catch mechanism 120 can be disposed within the first side 106, and the sight pusher control 140 can be disposed through the second side 108. FIG. 7 is a top plan view of a slide capture handgun sight pusher 100 wherein the front face 102, and rear face 103 can be disposed opposite each other in frame 101. A tool 150 may be disposed within the ergonomic handle 148. A finger grip 160 can be disposed on a third side opposite the ergonomic handle 148. FIG. 8 is a bottom plan view of a slide capture handgun sight pusher 100 wherein the front face 102, and rear face 103 can be disposed opposite each other in frame 101. An adjustment knob 128 of a slide catch mechanism 120 can be disposed within the first side 106 of frame 101.

Figure 9:
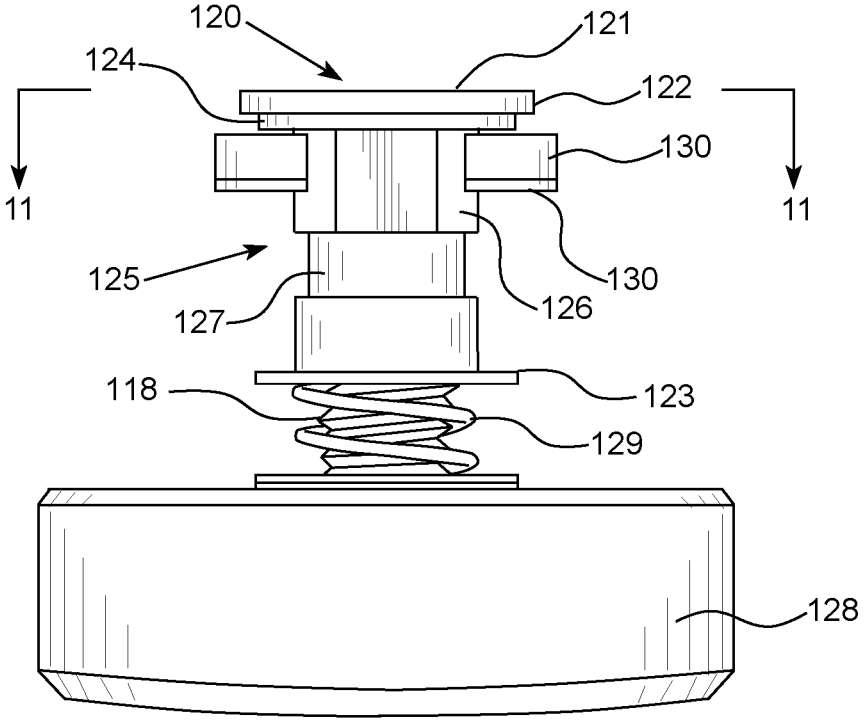
FIG. 9 is a front plan view of a slide catch mechanism removed from the frame of the slide capture handgun sight pusher of FIG. 1.
Figure 10:
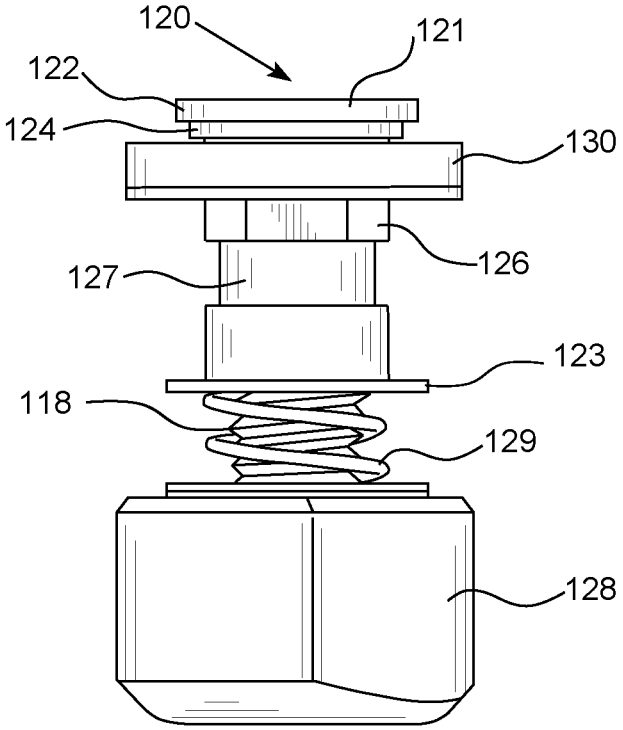
FIG. 10 is a side plan view of a slide catch mechanism removed from the frame of the slide capture handgun sight pusher of FIG. 1.

In FIGS. 9 & 10, there is a partial view of slide capture handgun sight pusher 100 illustrating an embodiment of a slide catch mechanism 120. Where FIG. 9 is a front view, and FIG. 10 is a side view. Cap 121 can be disposed onto a shaft 125, where shaft 125 can include multiple geometric segments, such as a rectangular segment 126 and a rounded segment 127. Disposed around the threaded bolt 118 may be a spring 129, which can abut the adjustment knob 128 and either the washer 123 or the first side 106 of the frame 101, depending on the inclusion of the washer 123 in the embodiment.

Figure 11:
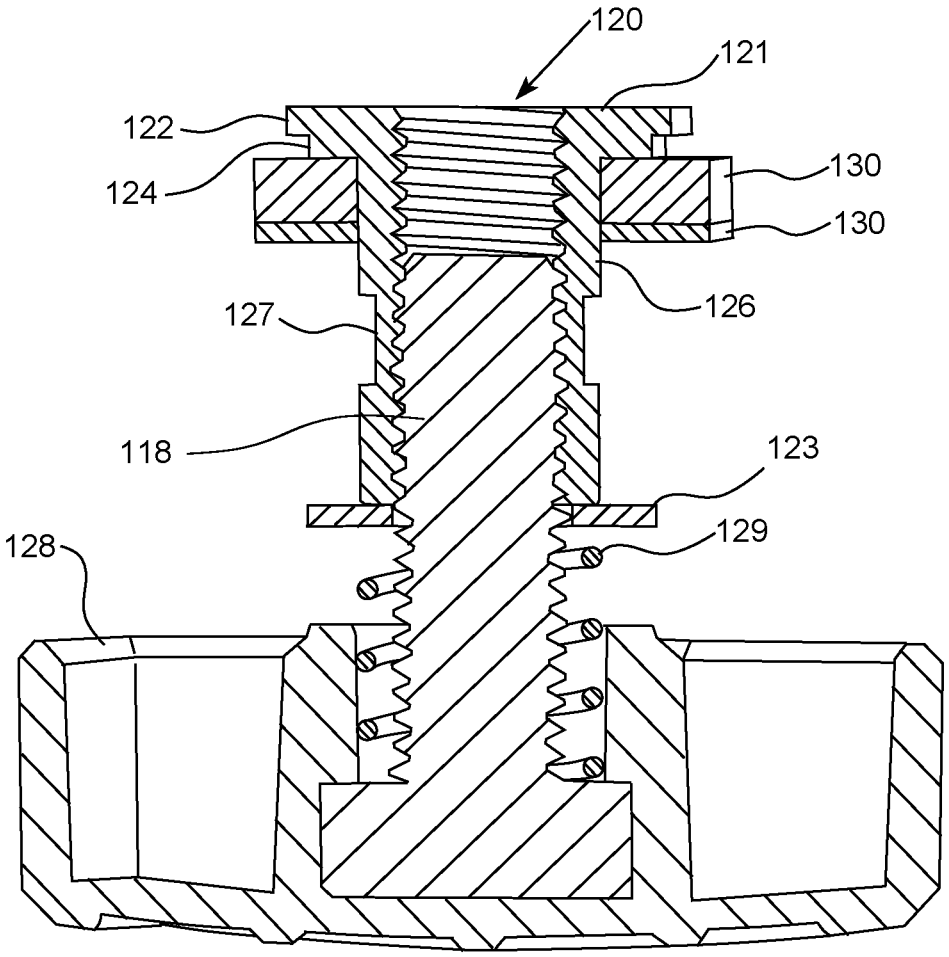
FIG. 11 is a cross-section view of the slide catch mechanism of FIG. 9.
Figure 12:
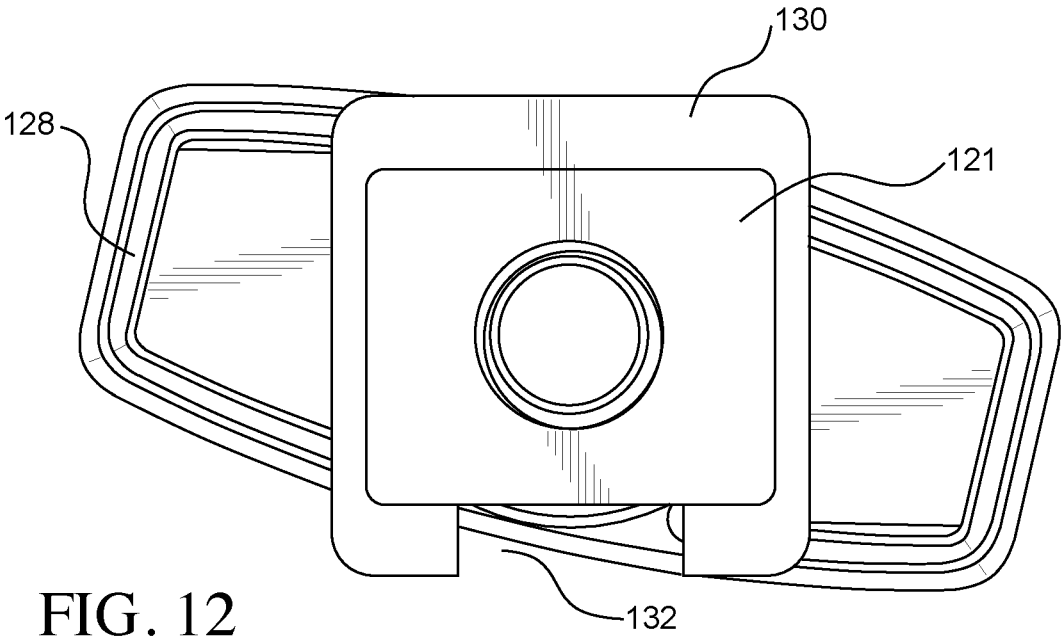
FIG. 12 is top plan view of the slide catch mechanism of FIG. 9.
Figure 13:
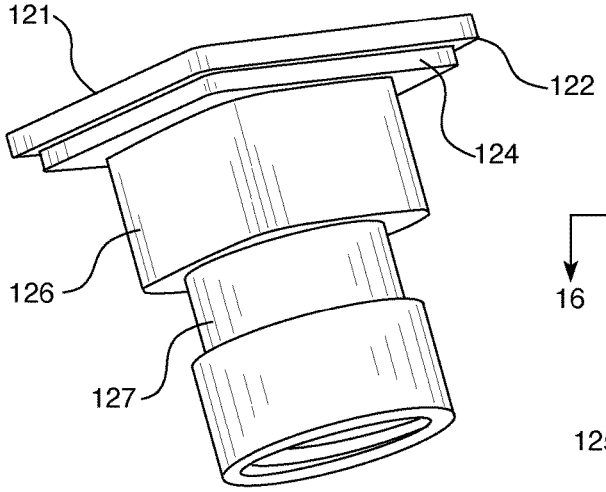
FIG. 13 is an exploded front perspective view of the slide catch mechanism of FIG. 9.

FIG. 11 is a cross-sectional view of the slide catch mechanism 120 illustrated in FIG. 9. FIG. 12 is a top plan view of the slide catch mechanism 120 illustrated in FIG. 9, illustrating the different dimensions of the cap 121 and the shim(s) 130, where the shim 130 can include opening 132. FIGS. 13-16 are further partial views of a slide capture handgun sight pusher 100 illustrating the intricacies of the combination of cap 121 and shaft 125, which will be discussed in detail infra.

Figure 19:
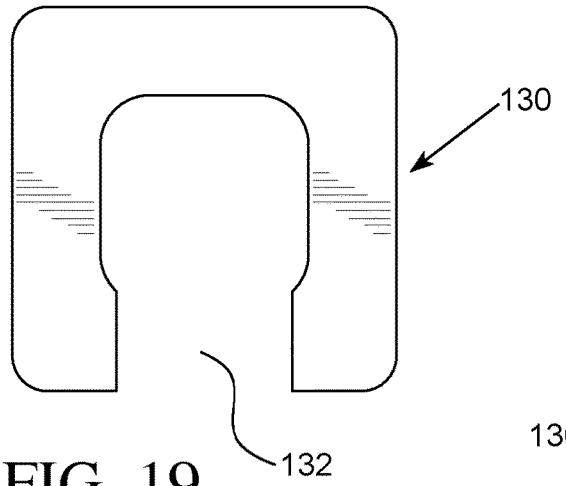
FIG. 19 is a top plan view of an additional shim that may be present in a slide capture handgun sight pusher.
Figure 20:
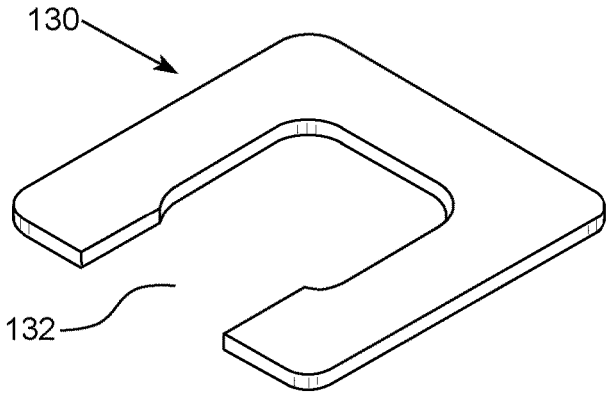
FIG. 20 is a front perspective view of the shim in FIG. 19.
Figure 21:
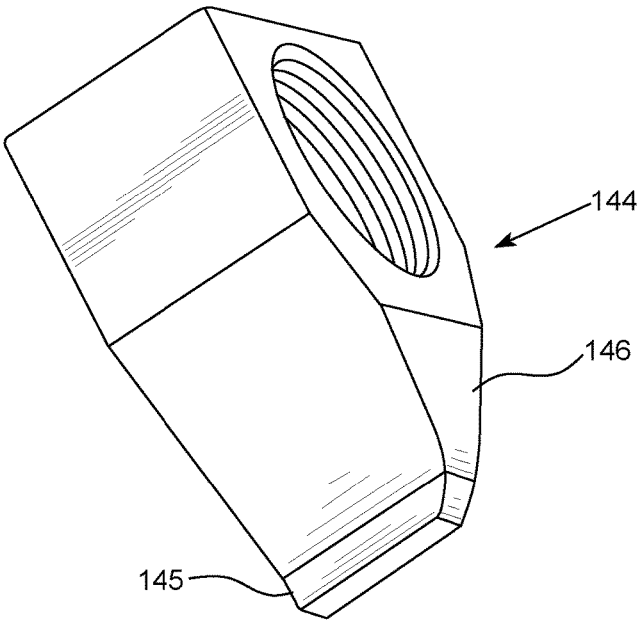
FIG. 21 is a perspective view of a press-block tooth of the slide capture handgun sight pusher of FIG. 1.
Figure 22:
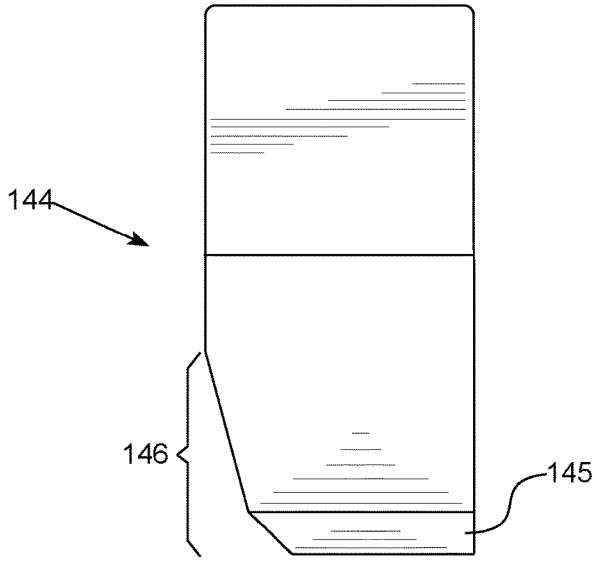
FIG. 22 is a front side view of a press-block tooth of the slide capture handgun sight pusher of FIG. 1.
Figure 23:
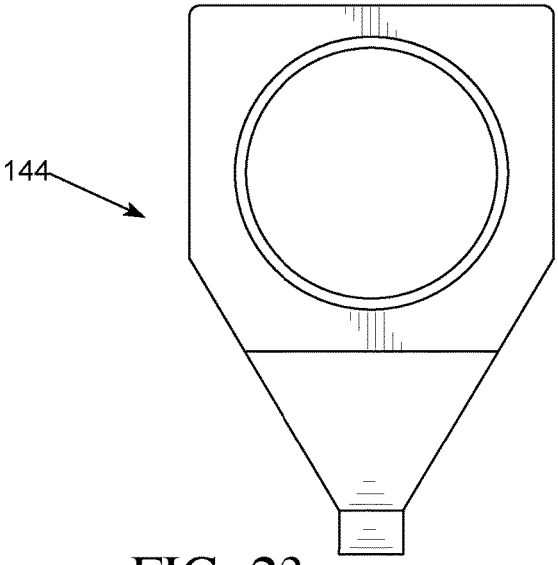
FIG. 23 is a left side view of a press-block tooth of the slide capture handgun sight pusher of FIG. 1.

FIGS. 17-20 are views illustrating different embodiments of shims 130 where their thicknesses can vary and can include openings 132. FIGS. 21-23 are partial views of a slide capture handgun sight pusher 100 illustrating the intricacies of a press-block tooth 144 where there can be a first engagement surface 145 and a second engagement surface 146.

Figure 24:
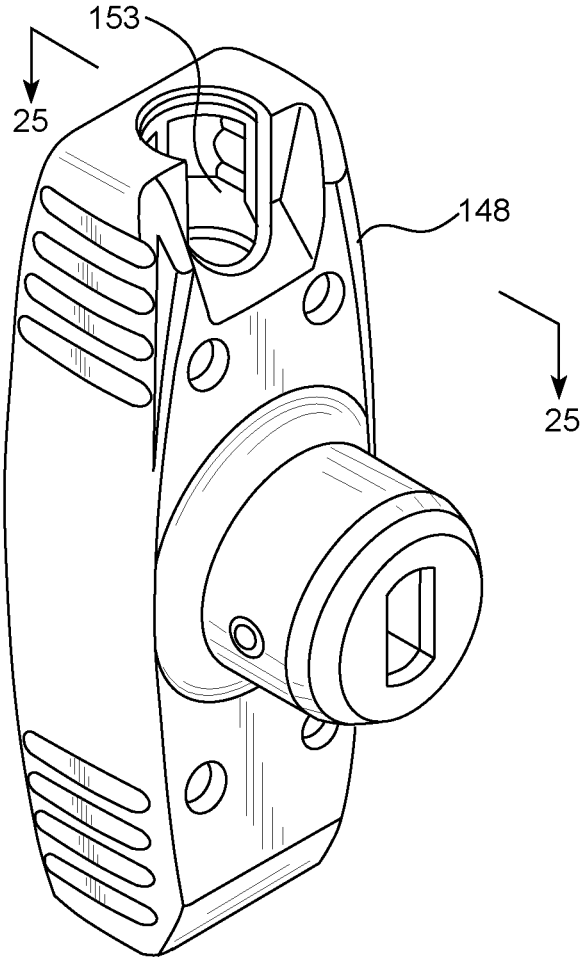
FIG. 24 is a perspective view of an ergonomic handle of the slide capture handgun sight pusher of FIG. 1.
Figure 25:
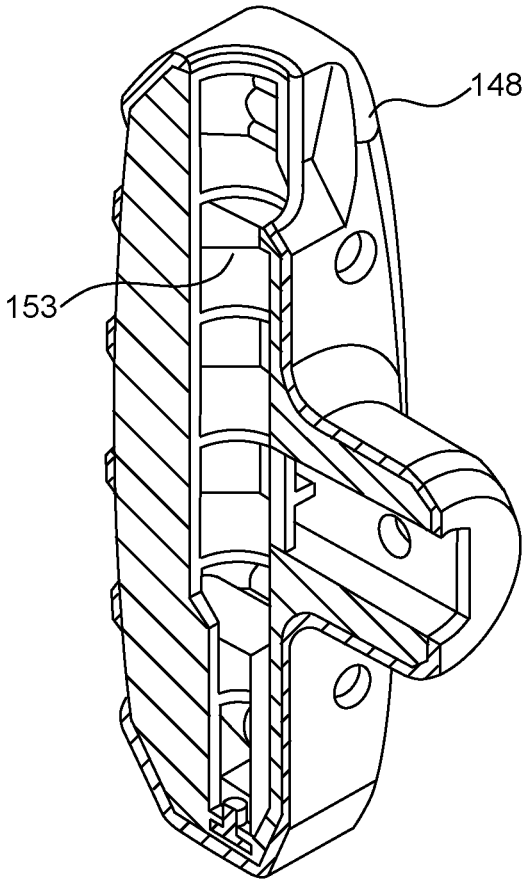
FIG. 25 is a cross-section view of an ergonomic handle in FIG. 24.
Figure 26:
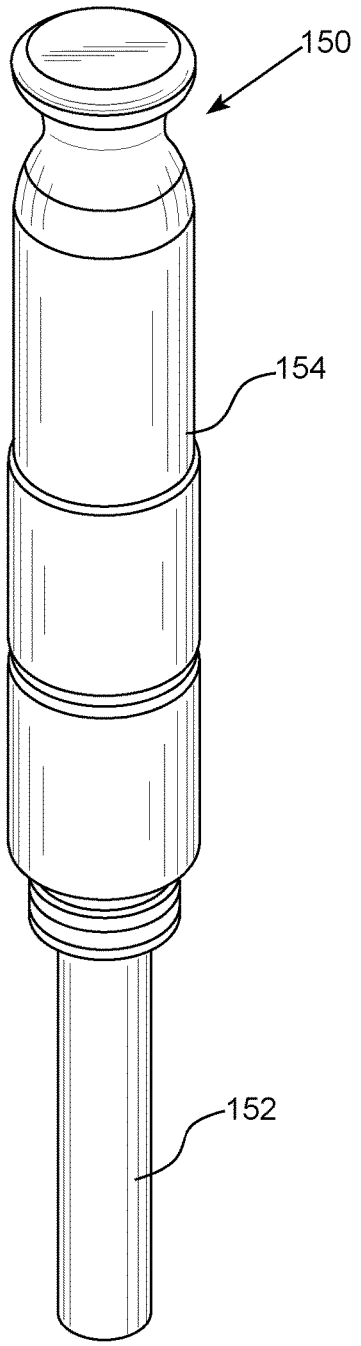
FIG. 26 is a front side view of a tool insert of the slide capture handgun sight pusher of FIG. 1.
Figure 27:
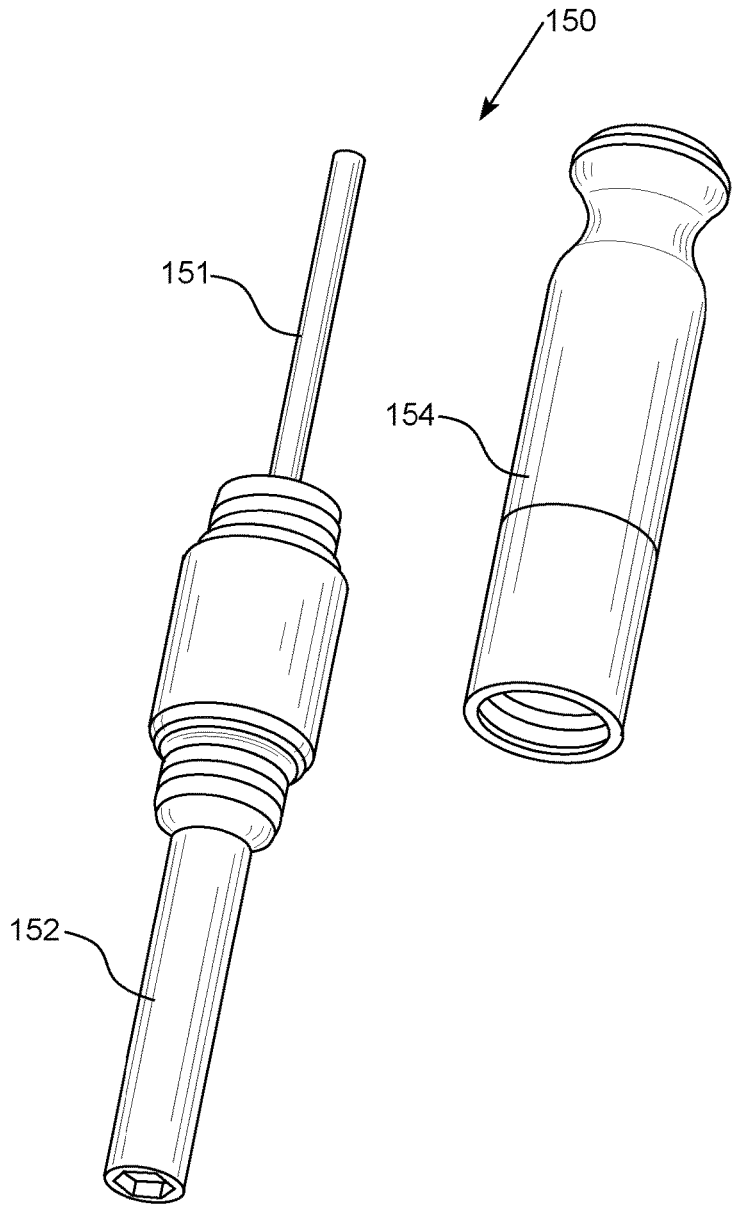
FIG. 27 is an exploded of the tool insert of FIG. 26.

FIGS. 24-25 are further partial views of a slide capture handgun sight pusher 100 illustrating the intricacies of the ergonomic handle 148 where a tool storage compartment 153 can be disposed therein. FIGS. 26-27 illustrate a tool 150, which may include a removable cover 154 that can attach to either end of the tool 150, thereby enclosing a first tool 151 or a second tool 152.

FIG. 1 illustrates an embodiment of a slide capture handgun sight pusher 100, which includes frame 101. Frame 101 can include a front face 102 and a rear face 103 where a central opening 104 can be disposed there therethrough. The central opening 104 can allow access for attachment of a firearm's slide to a slide catch mechanism 120. The slide of the firearm can include internal rails, where the cap 121 of the slide catch mechanism 120 can be structured to abut the internal rails of the firearm's slide. Furthermore, cap 121 may be capable of rotating in ninety-degree increments to present different widths of cap 121 into the slide rails of a firearm slide. This rotation may be achieved with the adjustment of slide catch mechanism 120, which can be disposed within a first side 106 of frame 101. As illustrated in FIG. 2, shaft 125 can pass through the first side 106.

The below description will refer to FIGS. 9 and 11 that illustrates the slide catch mechanism 120 in more detail. In FIG. 9, the slide catch mechanism 120 is shown separate from frame 101. However, removal of the slide catch mechanism 120 from frame 101 is not necessary for the slide capture handgun sight pusher 100; the slide catch mechanism 120 may remain within frame 101 at all times during use as it is structured to function in that manner. Such functionality can occur due to the illustrated arrangement of the washer 123 or, alternatively, first side 106, in addition to shaft 125, threaded bolt 118, spring 129, and adjustment knob 128. Specifically, the slide catch mechanism 120 can rotate in ninety-degree increments within frame 101, where cap 121 may be disposed onto shaft 125. The shaft 125 can include multiple geometric segments. For example, in the embodiments in FIGS. 9-16, shaft 125 can include a first geometric segment 126, which may be rectangular, and a second geometric segment 127, which may be circular. In these particular embodiments, the first geometric segment 126 can be comprised of a square. The first geometric segment 126 may be structured and configured to correspond with an opening in the first side 106 of frame 101, which may mimic the shape of the first geometric segment 126, thereby preventing rotation of slide catch mechanism 120 during use. Additionally, the radius of the second geometric segment 127 can be less than the width of the first geometric segment 126. In some embodiments, the remaining portion of shaft 125, the section between the second geometric segment 127 and the adjustment knob 128, may also include a circular radius that can, at most, circumscribe the width of the first geometric segment 126.

The adjustment knob 128, as illustrated in FIG. 11, can include a threaded bolt 118 that can work in conjunction with the internal threading of shaft 125. With the rotation of the adjustment knob 128 in a first direction, the overall height of the slide catch mechanism 120 can be increased, and with the rotation of the adjustment knob 128 in an opposite direction, the overall height of the slide catch mechanism 120 may be decreased.

In an embodiment where the height of slide catch mechanism 120 is extended, the adjustment knob 128 may be depressed towards the first side 106. This action can compress spring 129 against either the washer 123 or the first side 106, and force shaft 125 into the central opening 104, exposing the entirety of the first geometric segment 126 and at least a portion of the second geometric segment 127 to the open space of central opening 104 above the first side 106. Once exposed, the slide catch mechanism 120 can be capable of rotating as the radius of geometric segment 127, and potentially, the remaining portion of shaft 125, can be less than the width of the first geometric segment 126, thus, allowing free rotational movement within the opening of the first side 106. Cap 121 may then be rotated in successive ninety-degree increments to present a desired orientation. Once rotated into a desired orientation, the adjustment knob 128 may be released, thereby decompressing the spring 129. By releasing the adjustment knob 128, the first geometric segment 126 may be reinserted into the opening of the first side 106.

In some embodiments, cap 121 can be comprised of a rectangular form, where a length is greater than a width. Such a configuration can allow cap 121 to abut the internal rails of multiple firearm slides because the distance between the firearm's slide rails can vary. With such capabilities, a slide capture handgun sight pusher 100 with a cap 121 in a rectangular form may provide sight adjustment for a variety of handguns with different desired orientations of the cap 121. FIG. 12 illustrates a cap 121 in a rectangular form.

An additional feature provided by the configuration of the geometric segments of shaft 125 can be the insertion of at least one shim 130 without the requirement to fully disassemble the slide catch mechanism 120. The incomplete ring, or penannular form, of shims 130 may allow for their insertion under cap 121 and onto shaft 125. As illustrated in FIGS. 17-20, shims can be provided in a variety of thicknesses. Regarding FIGS. 17-18, shim 130 can be a width of about 3.5 mm and can have an opening 132. The center space of shim 130 can be configured to approximately match the width and shape of the first geometric segment 126 of shaft 125. The opening 132 can be configured to approximately match the diameter of the second geometric segment 127. Therefore, when the slide catch mechanism 120 is in a compressed configuration (i.e., the slide adjustment knob 128 can be depressed, causing the exposure of the entirety of the first geometric segment 126 and at least a portion of the second geometric segment 127), a shim 130 may then be inserted on to the shaft 125 by passing the second geometric segment 127 through the opening 132. Once inserted, the central space of shim 130 may be aligned with the first geometric segment 126. The adjustment knob 128 may be released, allowing cap 121 to secure the shim 130 into a fixed position where the shim 130 both abuts the first side 106 and the cap 121. This process may include the insertion of a shim 130 having a lesser thickness of about 1 mm, as illustrated in FIGS. 19-20.

In some embodiments, two or more shims 130 may be inserted onto shaft 125. Such embodiments may allow for an even greater variety of firearms to have their sights adjusted within the slide capture handgun sight pusher 100 as the distance between the bottom of the cap 121 and first side 106 can range from 0 mm to 10 mm depending on the number of shims 130 that may be employed and their varied thickness. In some embodiments, the side opening 132 may be configured to match the width of the first geometric segment 126.

Figure 14:
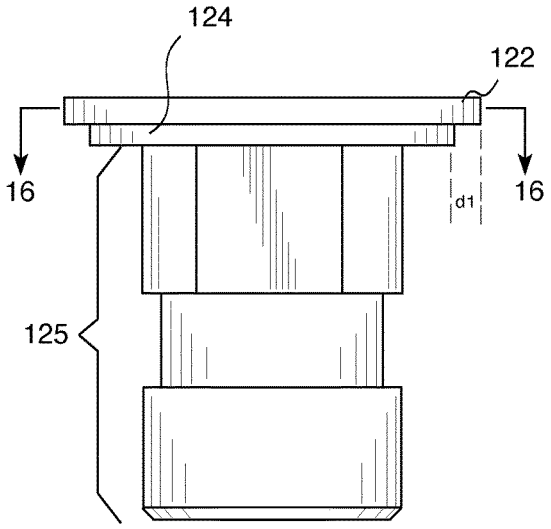
FIG. 14 is an exploded front plan view of the slide catch mechanism of FIG. 9.
Figure 15:
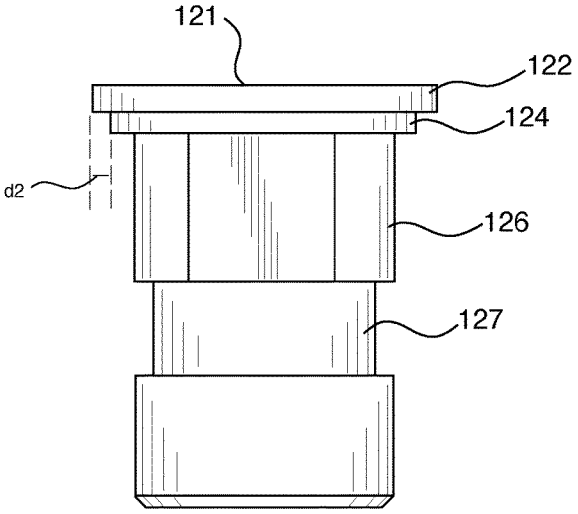
FIG. 15 is an exploded side plan view of the slide catch mechanism of FIG. 9.
Figure 16:
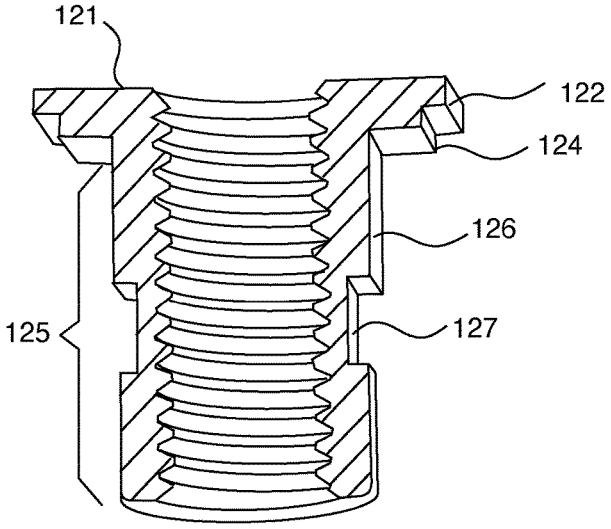
FIG. 16 is a cross-section view of the slide catch mechanism of FIG. 14.
Figure 17:
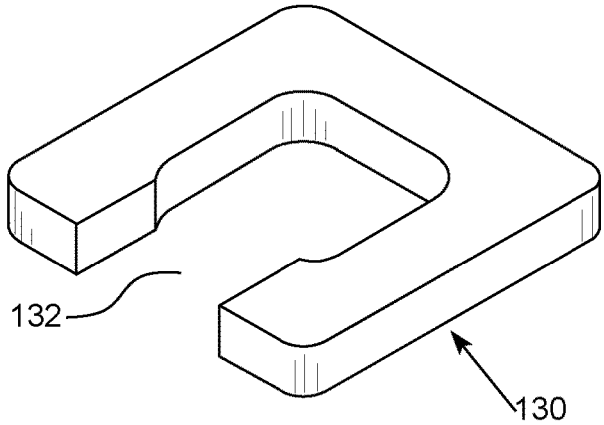
FIG. 17 is a front perspective view of a shim that may be present in a slide capture handgun sight pusher.
Figure 18:
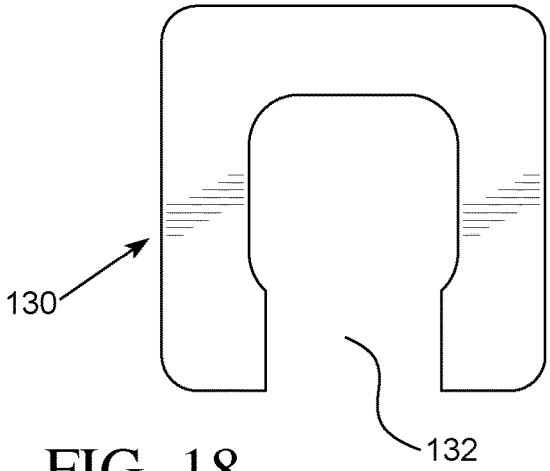
FIG. 18 is a top plan view of the shim in FIG. 17.

In some embodiments, cap 121 of the slide catch mechanism 120 can include multiple tiers. For example, as illustrated in FIGS. 9-11 and 13-16, cap 121 can include a first tier 122 and a second tier 124. These tiers can provide the slide catch mechanism 120 the ability to more securely engage the rails of firearm slides as their dimensions can vary per iteration of firearms. Additionally, some embodiments may include a first tier 122 having a length and width that is not symmetrical with a length and width of a second tier 124. More specifically, as shown in FIGS. 14-15, a distance d1 between the lengths of the first tier 122 and a second tier 124 can be different from a distance d2 between the widths of the first tier 122 and a second tier 124.

In regard to FIGS. 21-23, where a press-block tooth 144 is illustrated as having multiple engagement surfaces with a first engagement surface 145 and a second engagement surface 146. In FIG. 22, an embodiment of the press-block tooth 144 of the slide capture handgun sight pusher 100, can include a second engagement surface 146 comprised of a multi-tapered surface having at least two distinct angles for the engagement surface. In a particular embodiment, the angles can be about 75 degrees and about 45 degrees. The first engagement surface 145 may consist of a ninety-degree engagement surface.

The press-block tooth 144, as illustrated in FIGS. 2-3, can be disposed on the threaded rod 142. In some embodiments, the press-block tooth 144 can be positionally adjusted with the use of the sight pusher control mechanism 140 by turning the ergonomic handle 148 in a first direction. The press-block tooth 144 may be capable of traversing the length of the threaded rod 142 within the central opening 104. In such embodiments, either of the engagement surfaces may be used to adjust and/or remove a sight on a firearm slide, depending on the dimensions of the gun sight. In some cases, the press-block tooth 144 may be adjusted to a starting position in close proximity to the second side 108, whereas in other cases, the press-block tooth 144 may be adjusted to a starting position in close proximity to the third side opposite the second side 108. With such starting positions for the press-block tooth 144, firearm slides may be loaded onto the slide catch mechanism 120 such that the form of their sight matches either the first engagement surface 145 or the second engagement surface 146. During the loading process, the sight on the firearm slide can be aligned with the press-block tooth 144. After alignment, the adjustment knob 128 may be turned in a direction that can secure the firearm slide within the slide capture handgun sight pusher 100.

In some embodiments, a secured firearm slide having its sight aligned with the press-block tooth 144 can then have the sight situated in a desired position with the use of the press-block tooth 144 by pressing the press-block tooth 144 against the aligned sight. Force may be applied against the sight by turning the ergonomic handle 148 in a first or second direction, depending on the starting position of the press-block tooth 144. The sight can then be placed in the desired position or removed from the firearm slide entirely. The applied force can be easily achieved as the size and shape of the ergonomic handle can reduce the amount of torque needed to be applied by an end user. The embodiments in FIGS. 1-3, and 5-8 illustrate sight pusher control mechanism 140 having an oversized ergonomic handle 148 which, in conjunction with the diameter and thread pitch of the threaded rod 142, may reduce the amount of force needed to obtain the required torque needed to adjust a firearm sight with the press-block tooth 144.

As illustrated in FIGS. 24-25, some embodiments have an ergonomic handle 148 that further comprises a tool storage compartment 153. In such embodiments, tool 150 can be stored within the tool storage compartment 153. Tool 150 can comprise a two-ended device where each end can comprise a different firearm adjustment tool. For example, as illustrated in FIGS. 26-27, tool 150 can include a first tool 151 and a second tool 152, where either tool end may be covered with a tool cap 154. Tool 150 may include threading on the proximal ends of the first tool 151 and the second tool 152, thereby allowing a cap 154 within internal threading to engage with tool 150. The first tool 151 and the second tool 152 may comprise drivers such as nut or screwdrivers and pin-punches.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is also intended to include features of a claim in any other independent claim, even if this claim is not directly made dependent to the independent claim.

What is claimed is:

1. A sight adjustment device for a firearm comprising:
- a frame comprising:
  - a front face,
  - a back face,
  - a central opening disposed through the front face to the back face,
  - a first side, and
  - a second side;
- a firearm slide catch connected to the first side of the frame, the firearm slide catch comprising:
  - a cap,
  - an adjustment knob,
  - a shaft being disposed between the cap and the adjustment knob, wherein the adjustment knob is structured and configured to change a distance between the cap and the first side, and
  - a spring disposed between the first side and the adjustment knob; and
- a sight pusher at least partially disposed through the second side of the frame, the sight pusher having:
  - a threaded rod connected to a handle, and
  - a press-block tooth disposed on the threaded rod.

2. The sight adjustment device of claim 1, wherein the firearm slide catch is structured and configured to receive at least one shim and abut interior rails of a firearm slide.

3. The sight adjustment device of claim 2, wherein the at least one shim is receivable by the firearm slide catch while the adjustment knob remains connected to the shaft of the firearm slide catch.

4. The sight adjustment device of claim 3, wherein the cap is approximately rectangular and rotatable into consecutive ninety-degree orientations while the adjustment knob remains connected to the shaft of the firearm slide catch.

5. The sight adjustment device of claim 4, wherein the shaft of the firearm slide catch comprises at least two geometric segments that are stacked in line with the cap:
- a first segment having an approximately rectangular shape; and
- a second segment having an approximately cylindrical shape.

6. The sight adjustment device of claim 5, wherein the second segment has a diameter less than a width of the first segment.

7. The sight adjustment device of claim 6, wherein the at least one shim is penannular with a central interior opening shaped to match the first segment of the shaft, and a side opening, leading to the central interior opening.

8. The sight adjustment device of claim 1, wherein the firearm slide catch further comprises a threaded bolt, wherein the threaded bolt can be received by the shaft and the adjustment knob.

9. The sight adjustment device of claim 1, wherein
- the cap of the firearm slide catch has a stepped configuration,
- a top step is wider and longer than a bottom step, and
- a first distance between a length of the top step and a length of the bottom step is different from a second distance between a width of the top step and a width of the bottom step.

10. The sight adjustment device of claim 1, wherein a handgrip is disposed on an exterior surface of a third side of the frame and the handle of the sight pusher includes a tool storage component.

11. The sight adjustment device of claim 1, wherein the press-block tooth is comprised of at least two engagement surfaces.

12. The sight adjustment device of claim 11, wherein a first engagement surface of the press-block tooth is a vertical surface, and a second engagement surface of the press-block tooth is a multi-tapered surface.

13. A method of using a sight adjustment device comprising the following steps:

providing a sight adjustment device comprising:

a frame having a front face, a back face, a central opening disposed through the front face to the back face, a first side, and a second side, a firearm slide catch disposed within the first side of the frame, comprising:

a cap, wherein the cap has at least four faces, an adjustment knob, a shaft disposed between the cap and the adjustment knob, a spring disposed between the first side and the adjustment knob, and a sight pusher disposed through the second side of the frame;

determining a distance between rails of a firearm slide;

depressing the adjustment knob, thereby compressing the spring;

rotating the cap to match a width of the cap to the distance between rails of the firearm slide;

determining a distance between the rails of the firearm slide and a bottom of the firearm slide;

releasing the adjustment knob thereby decompressing the spring; and securing the firearm slide onto the sight adjustment device by turning the adjustment knob in a first direction.

14. The method of using a sight adjustment device of claim 13, wherein the cap is approximately rectangular and can rotate into consecutive ninety-degree orientations.

15. The method of claim 13, further comprising inserting at least one shim between the firearm slide catch and the frame.

16. The method of using a sight adjustment device of claim 15, wherein the shaft comprises at least two geometric segments:

a first segment, having an approximately rectangular shape, and being disposed on the cap;

a second segment, having an approximately cylindrical shape, and being disposed on the first segment opposite the cap; and wherein the compressing of the spring frees the first segment of the shaft from the frame, and the decompressing of the spring reinserts the first segment of the shaft into the frame in a desired orientation.

17. The method of using a sight adjustment device of claim 16, wherein the second segment has a diameter less than a width of the first segment.

18. The method of using a sight adjustment device of claim 17, wherein the at least one shim is penannular having a central interior opening shaped to match the first segment of the shaft and a side opening, leading to the central interior opening, wherein the side opening is configured to match the diameter of the second segment.

19. The method of using a sight adjustment device of claim 13, wherein the cap has a stepped configuration, wherein a top step is wider and longer than a bottom step.

20. A sight adjustment device for a firearm comprising:

a frame comprising:

a front face, a back face, a central opening disposed through the front face to the back face, a first side, and a second side;

a firearm slide catch connected to the first side of the frame, the firearm slide catch comprising:

a cap, an adjustment knob, a shaft being disposed between the cap and the adjustment knob, wherein the adjustment knob is structured and configured to change a distance between the cap and the first side, a spring disposed between the first side and the adjustment knob, and wherein the firearm slide catch is structured and configured to receive at least one shim, and while the adjustment knob remains operably connected to the shaft; and a sight pusher having a threaded rod, a handle, and a press-block tooth.

21. The sight adjustment device of claim 20, wherein the at least one shim is penannular with a central interior opening shaped to match a first segment of the shaft, and a side opening, leading to the central interior opening, wherein the side opening is configured to match a diameter of a second segment of the shaft.

22. The sight adjustment device of claim 21, wherein the first segment of the shaft comprises an approximately rectangular shape, and is disposed on the cap; and the second segment of the shaft comprises an approximately cylindrical shape, and is disposed on the first segment opposite the cap.

23. The sight adjustment device of claim 22, wherein the cap is approximately rectangular and rotatable into consecutive ninety-degree orientations while the adjustment knob remains connected to the shaft.

24. The sight adjustment device of claim 20, wherein the press-block tooth is comprised of at least two engagement surfaces, wherein a first engagement surface of the press-block tooth is a vertical surface, and a second engagement surface of the press-block tooth is a multi-tapered surface.

* * * * *